US006689430B2

(12) United States Patent
Sadasivan et al.

(10) Patent No.: US 6,689,430 B2
(45) **Date of Patent: *Feb. 10, 2004**

(54) INK JET RECORDING ELEMENT

(75) Inventors: Sridhar Sadasivan, Rochester, NY (US); Lixin Chu, Rochester, NY (US); John M. Baier, Fairport, NY (US); Yongcai Wang, Webster, NY (US); Lori J. Shaw-Klein, Rochester, NY (US); Elizabeth A. Gallo, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 62 days.

This patent is subject to a terminal disclaimer.

(21) Appl. No.: 09/943,952

(22) Filed: Aug. 31, 2001

(65) Prior Publication Data

US 2003/0049416 A1 Mar. 13, 2003

(51) Int. Cl.[7] ..... B41M 5/00

(52) U.S. Cl. ..... 428/32.34; 428/32.24; 428/32.25; 428/32.29; 428/32.3; 428/32.35; 428/32.36; 428/32.37; 428/32.38

(58) Field of Search ..... 428/195, 32.34, 428/32.24, 32.25, 32.29, 32.3, 32.35, 32.36, 32.37, 32.38

(56) References Cited

U.S. PATENT DOCUMENTS

| | | | | |
|---|---|---|---|---|
| 6,089,704 | A | 7/2000 | Burns et al. | |
| 6,096,469 | A | 8/2000 | Anderson et al. | |
| 6,447,110 | B1 * | 9/2002 | Chu et al. | 347/101 |
| 6,447,111 | B1 * | 9/2002 | Gallo et al. | 347/101 |

FOREIGN PATENT DOCUMENTS

| | | |
|---|---|---|
| EP | 1 002 660 A1 | 5/2000 |

* cited by examiner

*Primary Examiner*—Pamela R. Schwartz

(57) ABSTRACT

An ink jet recording element comprising a support having thereon an image-receiving layer having: (a) inorganic particles having a primary particle size of from about 7 to about 40 nm in diameter which may be aggregated up to about 500 nm; (b) colloidal particles having a mean particle size of from about 20 to about 500 nm; and (c) water-insoluble, cationic, polymeric particles having at least about 20 mole percent of a cationic mordant moiety.

19 Claims, No Drawings

INK JET RECORDING ELEMENT

CROSS REFERENCE TO RELATED APPLICATIONS

Reference is made to commonly assigned, co-pending U.S. patent applications:

Ser. No. 09/944,555 by Chu et al., filed of even date herewith entitled "Ink Jet Printing Method" now U.S. Pat. No. 6,447,110;

Ser. No. 09/944,618 by Sadasivan et al., filed of even date herewith entitled "Ink Jet Recording Element";

Ser. No. 09/944,619 by Chu et al., filed of even date herewith entitled "Ink Jet Printing Method" now U.S. Pat. No. 6,443,570;

Ser. No. 09/944,547 by Sadasivan et al., filed of even date herewith entitled "Ink Jet Recording Element";

Ser. No. 09/945,088 by Gallo et al., filed of even date herewith entitled "Ink Jet Printing Method" now U.S. Pat. No. 6,447,111;

Ser. No. 09/943,957 by Sadasivan et al., filed of even date herewith entitled "Ink Jet Recording Element";

Ser. No. 09/945,035 by Gallo et al., filed of even date herewith entitled "Ink Jet Printing Method";

Ser. No. 09/944,971 by Sadasivan et al., filed of even date herewith entitled "Ink Jet Recording Element"; and Ser. No. 09/945,085 by Gallo et al., filed of even date herewith entitled "Ink Jet Printing Method" now U.S. Pat. No. 6,431,701.

FIELD OF THE INVENTION

The present invention relates to a porous ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An inkjet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of ink jet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by cast coating, in which a particulate-containing coating is applied to a support and is dried in contact with a polished smooth surface.

When a porous recording element is printed with dye-based inks, the dye molecules penetrate the coating layers. However, there is a problem with such porous recording elements in that the optical densities of images printed thereon are lower than one would like. The lower optical densities are believed to be due to optical scatter which occurs when the dye molecules penetrate too far into the porous layer.

EP 1,002,660 relates to a porous inkjet recording element comprising fine particles, hydrophilic binder and a water-soluble, cationic polymer. However, there is a problem with this element in that the density of an image printed on such an element using a water-soluble cationic polymer is lower than one would like.

U.S. Pat. No. 6,089,704 relates to a nonporous ink jet recording element comprising a cationic polymeric vinyl latex and a hydrophilic polymer. However, there is a problem with this nonporous recording element in that images printed thereon dry too slowly.

U.S. Pat. No. 6,096,469 relates to an ink jet recording element comprising mesoporous particles dispersed in an organic binder. In column 8, it is disclosed that the organic binder can be a cationic latex polymer "having less than 10 mole percent of a copolymerizable monomer having a tertamino or quaternary ammonium functionality." However, there is a problem with this element in that the density of an image printed on such an element with a binder having less than 10 mole percent of a cationic mordant functionality is lower than one would like.

It is an object of this invention to provide a porous ink jet recording element that when printed provides superior optical densities, good image quality and has an excellent dry time.

SUMMARY OF THE INVENTION

This and other objects are achieved in accordance with the invention, which comprises an ink jet recording element comprising a support having thereon an image-receiving layer comprising:

(a) inorganic particles having a primary particle size of from about 7 to about 40 nm in diameter which may be aggregated up to about 500 nm;

(b) colloidal particles having a mean particle size of from about 20 to about 500 nm; and (c) water-insoluble, cationic, polymeric particles comprising at least about 20 mole percent of a cationic mordant moiety.

The porous inkjet recording element of the invention has superior optical densities, good image quality and has an excellent dry time.

DETAILED DESCRIPTION OF THE INVENTION

Examples of (a) inorganic particles useful in the invention include alumina, boehmite, hydrated alumina, silica, titanium dioxide, zirconium dioxide, clay, calcium carbonate, inorganic silicates or barium sulfate. The particles may be porous or nonporous. In a preferred embodiment of the invention, the (a) inorganic particles are metallic oxides, preferably fumed. Preferred examples of fumed metallic oxides which may be used include silica and alumina fumed oxides. Fumed oxides are available in dry form or as dispersions of the aggregates.

While many types of inorganic particles are manufactured by various methods and commercially available for an image-receiving layer, porosity of the image-receiving layer is necessary in order to obtain very fast ink drying. The pores formed between the particles must be sufficiently large and interconnected so that the printing ink passes quickly through the layer and away from the outer surface to give the impression of fast drying. At the same time, the particles must be arranged in such a way so that the pores formed between them are sufficiently small so that they do not scatter visible light.

In another preferred embodiment of the invention, the (a) inorganic particles may be in the form aggregated particles. The aggregates are comprised of smaller primary particles about 7 to about 40 nm in diameter, and are aggregated up to about 500 nm in diameter. In still another preferred embodiment, the (a) inorganic particles have a mean aggregate particle size of from about 50 nm to about 200 nm.

Examples of (b) colloidal particles useful in the invention include alumina, boehmite, hydrated alumina, silica, titanium dioxide, zirconium dioxide, clay, calcium carbonate, inorganic silicates, barium sulfate or organic particles. Examples of organic particles useful in the invention are disclosed and claimed in U.S. patent application Ser. No. 09/458,401, filed Dec. 10, 1999, now U.S. Pat. No. 6,364,477; Ser. No. 09/608,969, filed Jun. 30, 2000, now U.S. Pat. No. 6,493,000; Ser. No. 09/607,417, filed Jun. 30, 2000, now U.S. Pat. No. 6,380,280; Ser. No. 09/608,466, filed Jun. 30, 2000, now U.S. Pat. No. 6,475,602; Ser. No. 09/607,419, filed Jun. 30, 2000, now U.S. Pat. No. 6,376,599; and Ser. No. 9/822,731, filed Mar. 30, 2001, now U.S. Pat. No. 6,541,103; the disclosures of which are hereby incorporated by reference. In a preferred embodiment of the invention, the (b) colloidal particles are silica, alumina, boehmite or hydrated alumina. The particles may be porous or nonporous. In another preferred embodiment of the invention, the (b) colloidal particles may be in the form of primary particles. In yet another preferred embodiment of the invention, the mean particle size of the primary particles may range from about 20 nm to about 500 nm.

The (c) water insoluble, cationic, polymeric particles comprising at least about 20 mole percent of a cationic mordant moiety useful in the invention can be in the form of a latex, water dispersible polymer, beads, or core/shell particles wherein the core is organic or inorganic and the shell in either case is a cationic polymer. Such particles can be products of addition or condensation polymerization, or a combination of both. They can be linear, branched, hyperbranched, grafted, random, blocked, or can have other polymer microstructures well known to those in the art. They also can be partially crosslinked. Examples of core/shell particles useful in the invention are disclosed and claimed in U.S. patent application Ser. No. 09/772,097, of Lawrence et al., Ink Jet Printing Method, filed Jan. 26, 2001, the disclosure of which is hereby incorporated by reference. Examples of water dispersible particles useful in the invention are disclosed and claimed in U.S. patent application Ser. No. 09/770,128, of Lawrence et al., Ink Jet Printing Method, filed Jan. 26, 2001, now U.S. Pat. No. 6,454,404; and U.S. patent application Ser. No. 09/770,127, of Lawrence et al., Ink Jet Printing Method, filed Jan. 26, 2001, now U.S. Pat. No. 6,503,608; the disclosures of which are hereby incorporated by reference. In a preferred embodiment, the (c) water insoluble, cationic, polymeric particles comprise at least about 50 mole percent of a cationic mordant moiety.

In another preferred embodiment of the invention, the (c) water insoluble, cationic, polymeric particles which may be used are in the form of a latex. In still another preferred embodiment of the invention, the latex contains a polymer having a quaternary ammonium salt moiety. In yet another preferred embodiment, the latex contains a polymer having a (vinylbenzyl)trimethyl ammonium salt moiety. In yet still another preferred embodiment, the latex contains a polymer having a (vinylbenzyl)dimethyl benzyl quaternary ammonium salt moiety. In yet another preferred embodiment, the (c) water-insoluble, cationic, polymeric particles comprises a mixture of a latex containing a polymer having a (vinylbenzyl)trimethyl quaternary ammonium salt moiety and a polymer having a (vinylbenzyl)dimethylbenzyl quaternary ammonium salt moiety.

The (c) water insoluble, cationic, polymeric particles useful in the invention can be derived from nonionic, anionic, or cationic monomers. In a preferred embodiment, combinations of nonionic and cationic monomers are employed. In general, the amount of cationic monomer employed in the combination is at least about 20 mole percent.

The nonionic, anionic, or cationic monomers employed can include neutral, anionic or cationic derivatives of addition polymerizable monomers such as styrenes, alpha-alkylstyrenes, acrylate esters derived from alcohols or phenols, methacrylate esters, vinylimidazoles, vinylpyridines, vinylpyrrolidinones, acrylamides, methacrylamides, vinyl esters derived from straight chain and branched acids (e.g., vinyl acetate), vinyl ethers (e.g., vinyl methyl ether), vinyl nitrites, vinyl ketones, halogen-containing monomers such as vinyl chloride, and olefins, such as butadiene.

The nonionic, anionic, or cationic monomers employed can also include neutral, anionic or cationic derivatives of condensation polymerizable monomers such as those used to prepare polyesters, polyethers, polycarbonates, polyureas and polyurethanes.

The (c) water insoluble, cationic, polymeric particles employed in this invention can be prepared using conventional polymerization techniques including, but not limited to bulk, solution, emulsion, or suspension polymerization. In a preferred embodiment of the invention, the (c) water insoluble, cationic, polymeric particles employed have a mean particle size of from about 10 to about 500 nm.

The amount of (c) water insoluble, cationic, polymeric particles used should be high enough so that the images printed on the recording element will have a sufficiently high density, but low enough so that the interconnected pore structure formed by the aggregates is not filled. In a preferred embodiment of the invention, the (a) inorganic particles are present in an amount from about 10 to about 50 weight % of the image-recording layer, the (b) colloidal particles are present in an amount of from about 50 to about 80 weight %, and the (c) water-insoluble, cationic, polymeric particles are present in an amount of from about 5 to about 30 weight %.

Examples of (c) water insoluble, cationic, polymeric particles which may be used in the invention include those described in U.S. Pat. No. 3,958,995, the disclosure of which is hereby incorporated by reference. Specific examples of these polymers include:

Polymer A. Copolymer of (vinylbenzyl) trimethylammonium chloride and divinylbenzene (87:13 molar ratio)

Polymer B. Terpolymer of styrene, (vinylbenzyl) dimethylbenzylamine and divinylbenzene (49.5:49.5:1.0 molar ratio)

Polymer C. Terpolymer of butyl acrylate, 2-aminoethylmethacrylate hydrochloride and hydroxyethylmethacrylate (50:20:30 molar ratio)

Polymer D. Copolymer of styrene, dimethylacrylamide, vinylbenzylimidazole and 1-vinylbenzyl-3-hydroxyethylimidazolium chloride (40:30:10:20 molar ratio)

Polymer E. Copolymer of styrene, 4-vinylpyridine and N-(2-hydroxyethyl)-4-vinylpyridinium chloride (30:38:32 molar ratio)

Polymer F. Copolymer of styrene, (vinylbenzyl) dimethyloctylammonium chloride), isobutoxymethyl acrylamide and divinylbenzene (40:20:34:6 molar ratio)

In a preferred embodiment of the invention, the image-receiving layer also contains a polymeric binder in an amount insufficient to alter the porosity of the porous receiving layer. In another preferred embodiment, the polymeric binder is a hydrophilic polymer such as poly(vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar—agar, arrowroot, guar, carrageenan, tragacanth, xanthan, rhamsan and the like. In still another preferred embodiment of the invention, the hydrophilic polymer is poly(vinyl alcohol), hydroxypropyl cellulose, hydroxypropyl methyl cellulose, gelatin, or a poly(alkylene oxide). In yet still another preferred embodiment, the hydrophilic binder is poly(vinyl alcohol). The polymeric binder should be chosen so that it is compatible with the aforementioned particles.

The amount of binder used should be sufficient to impart cohesive strength to the inkjet recording element, but should also be minimized so that the interconnected pore structure formed by the aggregates is not filled in by the binder. In a preferred embodiment of the invention, the binder is present in an amount of from about 5 to about 20 weight %.

The thickness of the image-receiving layer may range from about 5 to about 40 $\mu$m, preferably from about 10 to about 20 $\mu$m. The coating thickness required is determined through the need for the coating to act as a sump for absorption of ink solvent and the need to hold the ink near the coating surface.

In a preferred embodiment, the recording element also contains a base layer having at least about 50% by weight of inorganic particles. The base layer is coated between the support and the image-receiving layer. In another preferred embodiment, the inorganic particles in the base layer comprise calcium carbonate, magnesium carbonate, barium sulfate, silica, alumina, boehmite hydrated alumina, clay or titanium oxide. In another preferred embodiment, the inorganic particles in the base layer have an anionic surface charge. In yet another preferred embodiment, the inorganic particles in the base layer have a mean particle size of from about 100 nm to about 5 $\mu$m.

In still another preferred embodiment, the base layer contains a binder such as a polymeric material and/or a latex material, such as poly(vinyl alcohol) and/or styrene-butadiene latex. In still another preferred embodiment, the binder in the base layer is present in an amount of from about 5 to about 20 weight %. In still another preferred embodiment, the thickness of the base layer may range from about 5 $\mu$m to about 50 $\mu$m, preferably from about 20 to about 40 $\mu$m.

After coating, the ink jet recording element may be subject to calendering or supercalendering to enhance surface smoothness. In a preferred embodiment of the invention, the ink jet recording element is subject to hot, soft-nip calendering at a temperature of about 65° C. and pressure of 14000 kg/m at a speed of from about 0.15 m/s to about 0.3 m/s.

The support for the ink jet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the ink-receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, rod coating, air knife coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

In order to impart mechanical durability to an inkjet recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30% active coating aid based on the total solution weight. These coating aids can be nonionic, anionic, cationic or amphoteric. Specific examples are described in MCCUTCHEON's Volume 1: Emulsifiers and Detergents, 1995, North American Edition.

The coating composition can be coated either from water or organic solvents, however water is preferred. The total solids content should be selected to yield a useful coating thickness in the most economical way, and for particulate coating formulations, solids contents from 10–40% are typical.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following example is provided to illustrate the invention.

EXAMPLE

The following comparative cationic polymers used are water-soluble:

C-1 Poly(vinylbenzyl)trimethylammonium chloride, available as Chemistat® 6300H from Sanyo Chemical Industries.

C-2 Polypropylene oxide-based triamine, available as Jeffamine® T-5000 from Huntsman, Corp.

Element 1 of the Invention

A coating solution for a base layer was prepared by mixing 100 dry g of precipitated calcium carbonate Albagloss-s® (Specialty Minerals Inc.) as a 70% solution and 8.5 dry g of silica gel Gasil® 23F (Crosfield Ltd.) with 0.5 dry g of a poly(vinyl alcohol) Gohsenol® GH-17 (Nippon Gohsei Co., Ltd.) as a 10% solution and 5 dry g of styrene-butadiene latex CP692NA® (Dow Chemicals) as a 50% solution. The solids of the coating solution was adjusted to 35% by adding water.

The base layer coating solution was bead-coated at 25° C. on a base paper, basis weight 185 g/m$^2$, and dried at 60° C. by forced air. The thickness of the base coating was 25 $\mu$m or 27 g/m$^2$.

A coating solution for the image-receiving layer was prepared by combining alumina Dispal® 14N4-80 (Condea Vista Co.), fumed alumina Cab-O-Sperse® PG003 (Cabot Corp.), poly(vinyl alcohol) (Gohsenol® GH-17, Nippon Gohsei Co.) and Polymer A illustrated above in a ratio of 66:20:4:10 to give an aqueous coating formulation of 15% solids by weight. Surfactants Zonyl® FS-300 (DuPont Co.) and Silwet® L-7602 (Witco Corp.) were added in small amounts as coating aids.

The image-receiving layer coating solution was coated on top of this base layer. The recording element was then dried at 60° C. by forced air to yield a two-layer recording element. The thickness of the image-receiving layer was 8 $\mu$m or 8.6 g/m$^2$.

Element 2 of the Invention

Element 2 was prepared the same as Element 1 except that Polymer B was used instead of Polymer A.

Element 3 of the Invention

Element 3 was prepared the same as Element 1 except that the ratio for the image-receiving layer was 62:19:4:15 for alumina to filmed alumina to poly (vinyl alcohol) to Polymer A.

Element 4 of the Invention

Element 4 was prepared the same as Element 1 except that the ratio for the image-receiving layer was 62:19:4:15 for alumina to fumed alumina to poly (vinyl alcohol) to Polymer B.

Comparative Element 1 (No Water-Insoluble, Cationic Polymeric Particles)

This element was prepared the same as Element 1 except that water-soluble Polymer C-1 was used instead of Polymer A.

Comparative Element 3 (No Cationic Polymeric Particles)

This element was prepared the same as Element 1 except that the image-receiving layer contained only alumina, fumed alumina and poly (vinyl alcohol) in the ratio 74:22:4.

Comparative Element 4 (No Aggregate Particles or Cationic Polymeric Particles)

This element was prepared the same as Element 1 except that the image-receiving layer contained only alumina and poly (vinyl alcohol) in a ratio of 96:4.

Comparative Element 5 (No Colloidal Particles or Cationic Polymeric Particles)

This element was prepared the same as Element 1 except that the image-receiving layer contained only fumed alumina and poly (vinyl alcohol) in a ratio of 96:4.

Density Testing

Test images of cyan, magenta, yellow, red, green and blue patches at 100% ink laydown were printed on the above elements using a Hewlett-Packard DeskJet 970 printer with an ink cartridge having catalogue number C6578DN.

After drying for 24 hours at ambient temperature and humidity, the Status A D-max densities were measured using an X-Rite® 820 densitometer. For each of the red, green and blue densities, the two component color densities were measured and averaged. The following results were obtained:

TABLE

| Recording | Status A D-max Density | | | | | |
|---|---|---|---|---|---|---|
| Element | Cyan | Magenta | Yellow | Red | Green | Blue |
| 1 | 1.0 | 1.5 | 1.9 | 1.5 | 1.3 | 1.6 |
| 2 | 1.0 | 1.4 | 1.7 | 1.3 | 1.2 | 1.5 |
| 3 | 1.1 | 1.6 | 1.9 | 1.5 | 1.3 | 1.6 |
| 4 | 1.0 | 1.4 | 1.7 | 1.4 | 1.2 | 1.5 |
| C-1 | 1.0 | 1.2 | 1.2 | 1.2 | 1.2 | 1.1 |
| C-2 | 1.0 | 1.2 | 1.1 | 1.1 | 1.1 | 1.1 |
| C-3 | 0.9 | 1.2 | 1.0 | 1.0 | 1.0 | 1.2 |
| C-4 | 0.9 | 1.2 | 1.2 | 1.2 | 1.1 | 1.4 |
| C-5 | 1.0 | 1.3 | 1.5 | 1.3 | 1.0 | 1.4 |

The above results show that the Status A D-max densities for the recording elements of the invention are higher in almost all colors as compared to the comparative elements.

Although the invention has been described in detail with reference to certain preferred embodiments for the purpose of illustration, it is to be understood that variations and modifications can be made by those skilled in the art without departing from the spirit and scope of the invention.

What is claimed is:

1. A porous ink jet recording element comprising a support having thereon an image-receiving layer comprising:

(a) inorganic particles having a primary particle size of from about 7 to about 40 nm in diameter which may be aggregated up to about 500 nm;

(b) colloidal particles having a mean particle size of from about 20 to about 500 nm; and (c) water insoluble, cationic, polymeric particles comprising at least about 20 mole percent of a cationic mordant moiety.

2. The recording element of claim 1 wherein said (a) inorganic particles are fumed silica or fumed alumina.

3. The recording element of claim 1 wherein said (a) inorganic particles have a mean particle size of from about 50 to about 200 nm.

4. The recording element of claim 1 wherein said (b) colloidal particles are alumina, boehmite, hydrated alumina, silica, titanium dioxide, zirconium dioxide, clay, calcium carbonate, inorganic silicates or barium sulfate.

5. The recording element of claim 1 wherein said (b) colloidal particles have a mean particle size of from about 50 to about 200 nm.

6. The recording element of claim 1 wherein said (c) water-insoluble, cationic, polymeric particles are in the form of a latex.

7. The recording element of claim 6 wherein said latex contains a polymer having a quaternary ammonium salt moiety.

8. The recording element of claim 1 wherein said (c) water-insoluble, cationic, polymeric particles comprises a mixture of latexes containing a polymer having a (vinylbenzyl)trimethyl quaternary ammonium salt moiety and a polymer having a (vinylbenzyl)dimethylbenzyl quaternary ammonium salt moiety.

9. The recording element of claim 1 wherein said water-insoluble, cationic, polymeric particles have a mean particle size of from about 10 to about 500 nm.

10. The recording element of claim 1 wherein said image-receiving layer also contains a binder in an amount of from about 5 to about 20 weight %.

11. The recording element of claim 10 wherein said binder is a hydrophilic polymer.

12. The recording element of claim 10 wherein said binder is a core/shell latex.

13. The recording element of claim 1 wherein a base layer comprising at least about 50% by weight of inorganic particles is coated between said support and said image-receiving layer.

14. The recording element of claim 13 wherein said inorganic particles in said base layer have an anionic surface charge.

15. The recording element of claim 13 wherein said inorganic particles in said base layer have a mean particle size of from about 100 nm to about 5 $\mu$m.

16. The recording element of claim 13 wherein said base layer comprises at least about 70% by weight of inorganic particles.

17. The recording element of claim 13 wherein said inorganic particles in said base layer comprise calcium carbonate, magnesium carbonate, barium sulfate, silica, alumina, boehmite, hydrated alumina, clay or titanium oxide.

18. The recording element of claim 13 wherein said base layer also contains a binder in an amount of from about 5 to about 20 weight %.

19. The recording element of claim 13 wherein said support is coated with said base layer and said image-receiving layer and is then calendered.

* * * * *